US005448803A

United States Patent [19]

Morell

[11] Patent Number: 5,448,803

[45] Date of Patent: Sep. 12, 1995

[54] MAGNETIC ROLLER

[75] Inventor: Ricardo Morell, Barcelona, Spain

[73] Assignee: Hollingsworth Saco Lowell, Inc., Greenville, S.C.

[21] Appl. No.: 214,868

[22] Filed: Mar. 17, 1994

[51] Int. Cl.[6] ..... D01H 5/54; H01F 1/00

[52] U.S. Cl. ..... 19/272; 29/895; 29/DIG. 95; 355/306

[58] Field of Search ..... 336/302, 306; 19/272; 118/657, 658; R29/895, 895.2, 895.213, 895.22, DIG. 25; 355/251

[56] References Cited

U.S. PATENT DOCUMENTS

| | | | |
|---|---|---|---|
| 2,686,940 | 8/1954 | Burnham | 19/135 |
| 2,951,266 | 9/1960 | Burnham | 19/131 |
| 3,029,479 | 4/1962 | Tarbox | 19/251 |
| 3,079,646 | 3/1963 | Burnham | 19/272 |
| 3,124,845 | 3/1964 | Stiepel et al. | 19/295 |
| 3,134,057 | 5/1964 | Tsunoo et al. | 317/201 |
| 3,149,403 | 9/1964 | Aurich et al. | 29/129.5 |
| 3,150,419 | 9/1964 | Aurich | 19/272 |
| 3,163,596 | 12/1964 | Ferris et al. | 209/219 |
| 3,292,126 | 12/1966 | Palm | 335/302 |
| 3,365,545 | 1/1968 | O'Neal et al. | 19/272 X |
| 3,457,618 | 7/1969 | O'Neal et al. | 29/125 |
| 3,481,006 | 12/1969 | Burnham | 19/272 |
| 3,599,305 | 8/1971 | Aurich | 19/272 X |
| 3,605,229 | 9/1971 | O'Neal et al. | 19/272 X |
| 3,742,852 | 7/1973 | Leffler et al. | 101/378 |
| 3,929,519 | 12/1975 | Benz | 335/306 |
| 4,580,121 | 4/1986 | Ogawa | 335/306 X |
| 4,823,102 | 4/1989 | Cherian et al. | 335/306 |
| 4,829,277 | 5/1989 | Stahura et al. | 335/306 |
| 4,992,767 | 2/1991 | Hozumi et al. | 335/306 X |
| 5,055,812 | 10/1991 | Abele et al. | 335/210 |
| 5,164,104 | 11/1992 | Kobayashi et al. | 335/302 X |

FOREIGN PATENT DOCUMENTS

| | | | |
|---|---|---|---|
| 1185961 | 1/1965 | Germany | 19/272 |
| 37-7369 | 7/1962 | Japan | 19/272 |
| 45-17382 | 11/1965 | Japan | 19/272 |
| 878256 | 12/1958 | United Kingdom . | |
| 936733 | 9/1963 | United Kingdom | 19/272 |

*Primary Examiner*—John J. Calvert

*Attorney, Agent, or Firm*—Leatherwood Walker Todd & Mann

[57] ABSTRACT

A magnetic roll for use in roller pairs of a drafting system on a textile machine. Each magnetic roll includes a central pole member having a rare earth magnet positioned on either side thereof. An end pole member is provided adjacent each magnet, and a cot is provided next to each end pole member for gripping and propelling fibers between the roller pairs of the drafting system.

30 Claims, 2 Drawing Sheets

MAGNETIC ROLLER

BACKGROUND OF THE INVENTION

This invention relates generally to a magnetic roller for use in the drafting system of a textile machine, such as a spinning machine, roving machine, drawframe, card machine, or the like.

In drafting fibers on a textile processing machine, such as a spinning machine, a band of fibers is passed between at least two pairs of rollers, the second, downstream, pair of rollers being driven at a faster rate than the first, upstream, pair of rollers such that the band of fibers becomes elongated, or "drafted" between the two pairs of rollers. A typical drafting system may include two pairs of such cooperating rollers or additional pairs of rollers to form successive drafting zones therebetween.

In order to draft the fibers, pressure must be applied between the rollers in each roller pair in a manner sufficient to cause the nip zone at the interface between the roller pair to both grip and propel the fibrous material. Weights, springs, levers, hydraulic, pneumatic or other pressure systems for forcing the rollers towards one another have been used in the past. However, a drawback of such systems is that they require substantial supporting structures to counteract the external weighting applied to the rollers. The supports must be strong enough to prevent undesirable deflection in the rollers being weighted. Also, bearings must be included which can both support the rollers for rotation and withstand the forces delivered by the external weighting.

As an alternative to the external weighting, magnetic weighting can be used. In magnetic weighting, at least one roll of each roller pair is magnetized such that it is attracted to the other roll of the pair, which is constructed of either a ferrous material or a magnetic material. In this system, the magnetic force between the rollers pulls the rollers together and applies sufficient pressure therebetween to grip and propel the fibers being processed. No additional weights, springs, levers, hydraulic or pneumatic systems are required for weighting the rollers. By eliminating the need for such weighting systems, the corresponding roller support structures can be simplified since roller deflection is essentially eliminated. Also, the bearing systems for the rollers will not have to withstand the externally-delivered forces caused by other types of weighting.

In some magnetic roller designs, the magnets are carried internally within the rollers and are contained within cylinders or sleeves. The shells are typically constructed of a non-magnetic material. With such magnetic roller designs, the magnets and corresponding pole members for the magnets are typically rotatably supported on gudgeons or journals.

Further, prior magnetic rollers were limited by the amount of magnetic force which could be delivered, due to the composition of the magnets used. Because of the type of magnets used and the diameter of the magnets required to achieve the necessary attractive force, a shorter, and therefore a more desirable, draft zone was not achievable between adjacent roller pairs. Additionally, prior magnetic rollers were prone to de-magnetization over time and could actually be de-magnetized if the rollers were not inserted and oriented properly with respect to adjacent rollers.

Prior magnetic roller designs include U.S. Pat. No. 3,134,057, issued to Tsunoo, et al, which discloses a magnetic roller having magnetic pieces fitted on pole rings. U.S. Pat. No. 3,150,419, issued to Aurich, discloses magnetic rollers having conventional magnets carried within a roll and housed by a metal sleeve. The magnets are separated by pole pieces, and gudgeons are used for supporting the rollers for rotation. German Patent document No. 1,185,961, discloses a magnetic roller having magnet rings adjacent to one another and iron pole pieces located adjacent to and outboard of the magnet rings. U.S. Pat. No. 3,457,618, issued to O'Neal, discloses a magnetic crush roll for use with a carding machine, the roll including magnetic modules carried on a shaft. U.S. Pat. Nos. 3,364,545 and 3,605,229, also disclose magnetic crush rolls.

U.S. Pat. No. 4,829,277, issued to Stahura, et al, and U.S. Pat. No. 5,055,812, issued to Abele, et al, both disclose magnetic resonance imaging devices used in the medical field. Each of the patents disclose the use of rare earth magnets of neodymium, iron, and boron alloy compositions.

While prior magnetic roller designs are available, they present limitations which may prevent desirable roller pressure interfaces being achieved between rolls of drafting roller pairs and also draft zones of minimum lengths.

SUMMARY OF THE INVENTION

It is the principal object of the present invention to provide a magnetic roller for use in a textile drafting system which allows for an increased gripping force between pairs of drafting rollers.

It is a further object of the present invention to provide a magnetic roller which allows for a draft zone of minimum length.

It is another object of the present invention to provide a magnetic roller which does not tend to de-magnetize over time.

It is still another object of the present invention to provide a magnetic roller which can be oriented in either of two directions.

It is still another object of the present invention to provide a system for forcing drafting roller pairs together without using springs or other systems for externally delivering pressure or weighting.

It is yet another object of the present invention to provide a drafting roller pair system which minimizes bottom roller deflection and bearing structural requirements.

Further, another object of the present invention is to provide a magnetic roller of minimum diameter.

These and other objects and aspects of the present invention will become further evident upon reference to the following drawings and accompanying specification.

Generally, one embodiment of the present invention includes a magnetic roller for use in conjunction with a driven roller of a drafting roller pair of a textile drafting system. The magnetic roll comprises at least one rare earth magnet and at least one resilient member associated with the rare earth magnet for engaging the driven roller of the textile drafting system. Such a roll would also include support means associated with the rare earth magnet and the resilient member for substantially coaxially supporting the magnet and the resilient member together for rotation in the textile drafting system.

A preferred embodiment of the present invention includes a magnetic roller for use in a textile drafting system of a spinning machine, roving machine, drawframe, card machine, or the like, comprising at least one substantially cylindrical central pole member having a first side and a second side opposite the first side. The central pole member defines a central pole member aperture therein. A first substantially cylindrical rare earth magnet is provided adjacent to the first side of the central pole member, and a second substantially cylindrical rare earth magnet is positioned adjacent to the second side of the central pole member. Each of the first and second rare earth magnets define an aperture therein.

Also provided is a first end pole member adjacent to the first rare earth magnet and opposite the first side of the central pole member. A second end pole member is provided adjacent to the second rare earth magnet and opposite the second side of the central pole member, each of the first and second end pole members defining an aperture therein.

An elongated shaft is also provided which passes through each aperture of the central pole member, the first and second rare earth magnets and the first and second end pole members, for maintaining the central pole member, the first and second rare earth magnets, and the first and second end pole members in substantially coaxial alignment with respect to one another.

More specifically, the magnetic roll of the present invention includes the pole members being individually greater in width, or mass, than either of the first and second rare earth magnets. Also, the rare earth magnets are preferably of a neodymium-iron-boron composition.

BRIEF DESCRIPTION OF THE DRAWING

The foregoing, as well as other objects of the present invention, will be further apparent from the following detailed description of the preferred embodiment of the invention, when taken together with the accompanying drawings, in which.

DESCRIPTION OF THE PREFERRED EMBODIMENT

Figure 1:
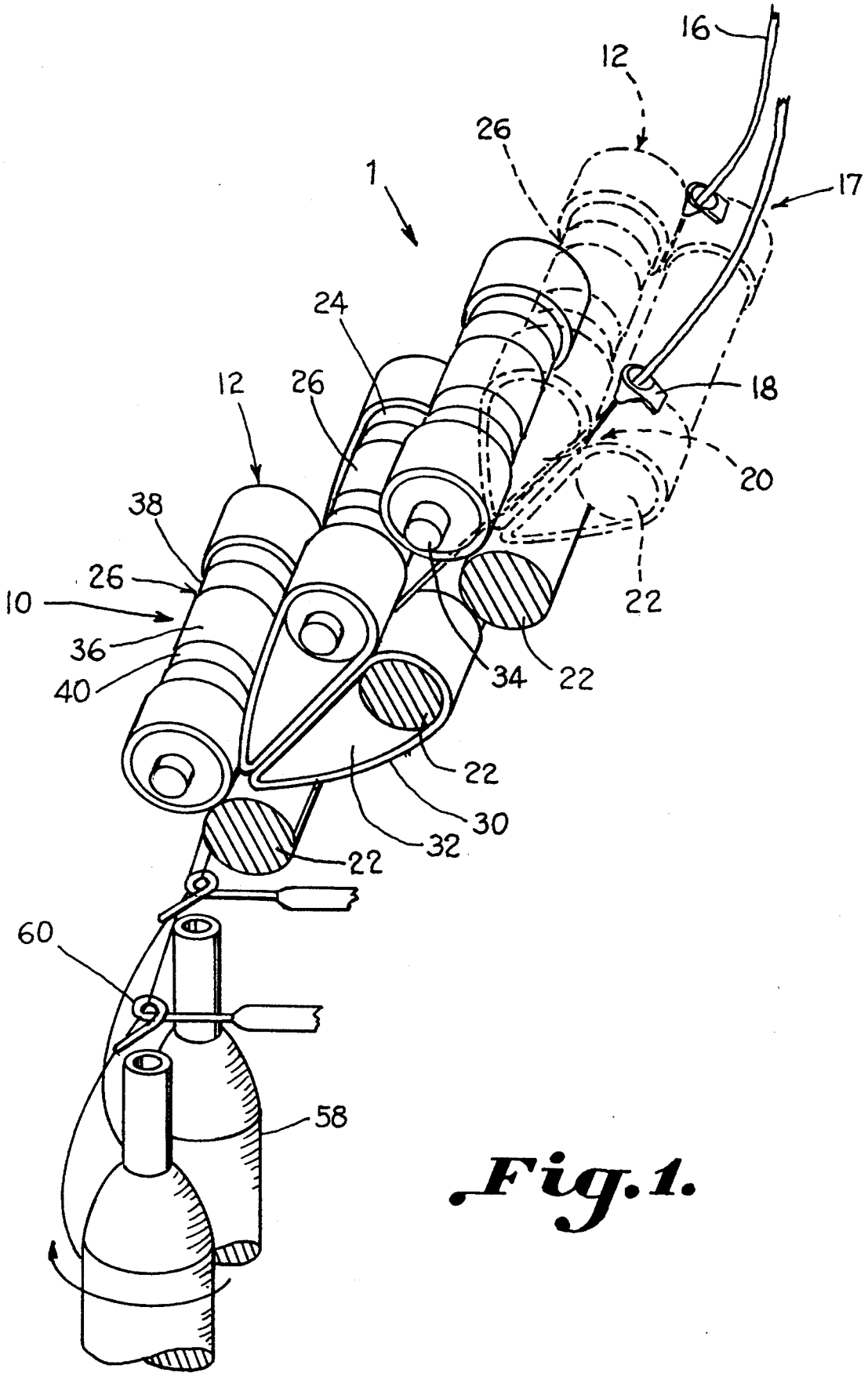
FIG. 1 is a perspective view of a magnetic roller assembly constructed in accordance with the present invention.

Referring to the drawings in detail, wherein like reference characters represent like elements or features throughout the various views, the magnetic roller of the present invention is designated generally in the Figures by a reference character 10.

Referring to FIG. 1 of the drawings, the magnetic roll system of the present invention is illustrated in a drafting system 1 for a spinning machine. The drafting system as shown in FIG. 1 includes four drafting roller pairs, generally 12, one pair 14 being shown in phantom, and includes slivers or rovings 16 entering through condensers or trumpets 18 and into a first roller pair 20 which includes a magnetic roller 10 constructed in accordance with the present invention. Magnetic roller 10 is attracted to a ferrous bottom roller 22, preferably constructed of steel, which may extend the length of the spinning machine or through several sections of the spinning machine. Each roller pair 12 includes an upper roller, generally 26, which is preferably a magnetic roller 10, and a lower roller 22.

Generally the lower roller 22 is driven while the upper roller 26 rotates through frictional interaction with the lower roller 22 brought about through the magnetic attraction of the upper roller 26 to the lower roller 22. Preferably, attached to the ends 24 of alternating upper rollers 26 and bottom rollers 28, are apron belts 30 which are propelled about carriers 32 by the rotation of the upper and lower rollers 26, 22. Use of belts 30 allows for a further reduction of the drafting zone length as the belts 30 allow fibers to be delivered and released closely adjacent to the nip zone of the succeeding downstream roller pair 12.

The upper roller 26 is carried for rotation through engagement of the ends of a support means or member such as a shaft 34, preferably constructed of non-magnetic steel, such as stainless steel, or other non-magnetic material, which passes through the entire length of each magnetic roller 10 and which extends outwardly from each end thereof. A holder which engages the ends of the shaft 34 is not shown, but could be of conventional design.

Figure 2:
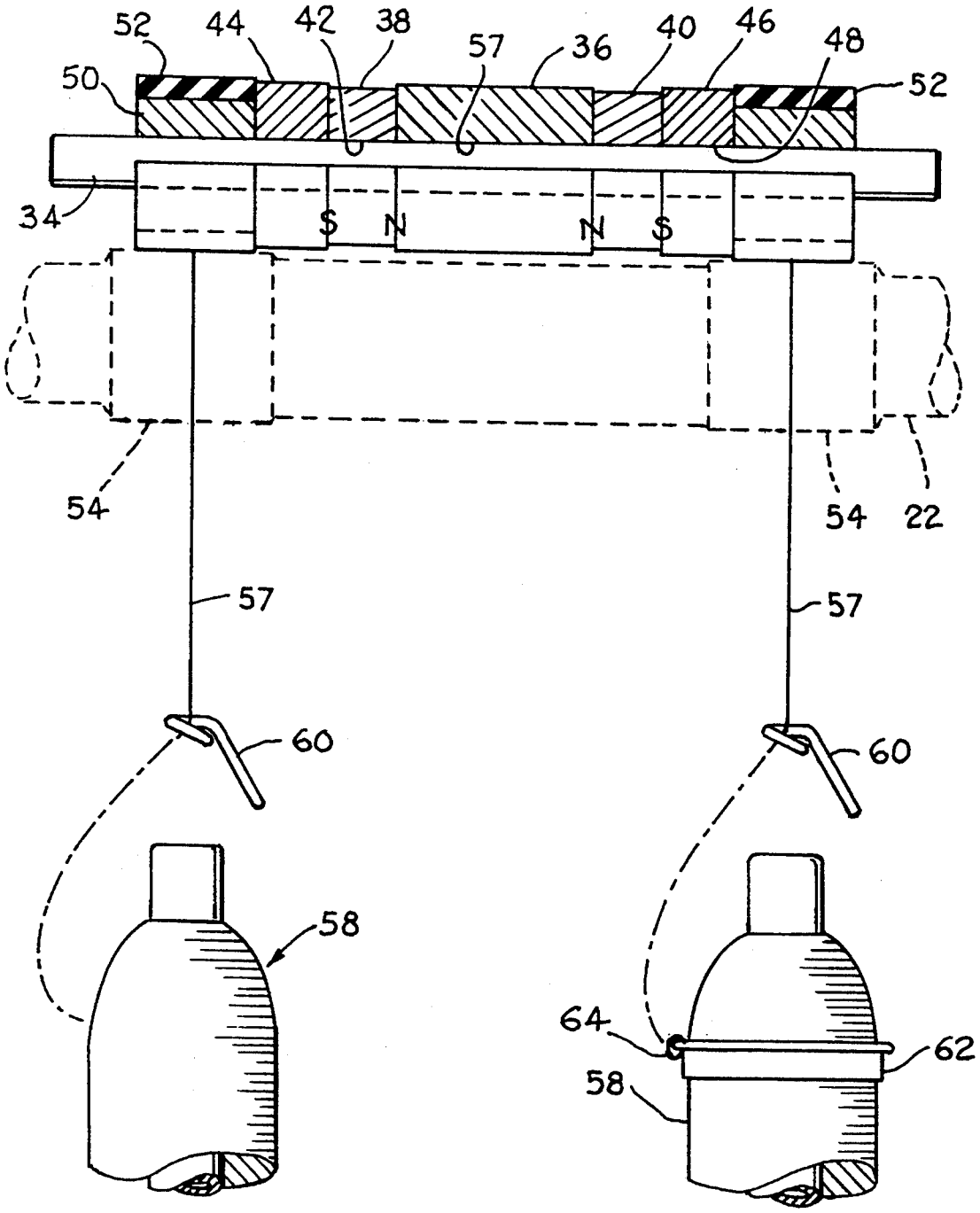
FIG. 2 is a side elevational view, with parts cut away, of a magnetic roller constructed in accordance with the present invention.

As illustrated in FIGS. 1 and 2, each magnetic roller 10 includes a substantially cylindrical central pole member 36, having an aperture 37 extending therethrough, centrally located along the length of the shaft 34. Positioned adjacent to and on either side of the central pole member 36 is a rare earth magnet 38, 40 constructed in accordance with the present invention. Each magnet 38, 40 is preferably of neodymium-iron-board composition, although a variety of other rare earth magnet compositions could also be used, and it is to be understood that the composition of the rare earth magnet is not to be limited to such a neodymium-iron-boron composition.

Each magnet 38, 40 defines a centrally located aperture 42 extending therethrough for receipt of the shaft 34. Positioned adjacent to each magnet, opposite the central pole member 36, are first and second end pole members 44, 46. The end pole members 44, 46 are also of cylindrical shape and have a hole 48 passing through the center thereof. The end pole members are preferably of slightly larger diameter than the magnets 38, 40, although they could be of greater, less or equal diameter, if desired. The central pole piece 36 and the end pole pieces 44, 46 are preferably constructed of steel, although other suitable ferrous or magnetic-attractive materials could also be used.

Positioned adjacent to each end pole piece 44, 46 is a cylindrical spacer 50, preferably constructed of a non-ferrous material such as aluminum, onto the surface of which a resilient member such as a rubber cot 52 is provided for rolling engagement with engagement portions 54 of the lower steel roll 22. The fibers being drafted are gripped and propelled by cots 52 the nip zone between the rubber cots 52 and the lower roll 22. Spacers 50 are preferably press-fit to shaft 34 to retain spacers 50, pole members 36, 44, 46 and magnets 38, 40 on shaft 34.

Roving or sliver passing through the drafting system 1, exits the final pair of rollers, and is spun into a yarn 57 in a conventional manner on a rotating bobbin 58 acting in conjunction with a thread guide 60 and a conventional ring 62 and traveller 64 system.

In one particular embodiment, the central pole member 36 is of greater width than the magnets 38, 40, which are each approximately the same width and diameter with respect to one another. Also in such embodiment, the end pole members 44, 46 are approximately the same width as the magnets 38, 40. Further, while the end pole pieces 44, 46 and central pole members 36 are approximately the same diameter, the central pole member 36 is preferably of a larger diameter than magnets 38, 40. While such a combination of dimensions has been found desirable, a variety of other widths and diameters of rare earth magnets and pole members could also be used to achieve satisfactory results.

The magnetic rollers 10 of the present invention exert a much greater magnetic force as compared to the magnets used in prior designs. This allows for greater strength in gripping of the fibers being drafted and also allows for reduction in the diameter of the magnetic rolls 10 as compared to prior magnetic roller designs. By reducing the diameter of the magnetic rolls, the drafting roller pairs 12 can be placed closer to one another, to thereby shorten the drafting zones therebetween, which, accordingly, allows for greater drafting control. In one embodiment, it has been found that magnetic rollers having magnets and pole members of approximately 28 mm in diameter can be used, which is generally a smaller diameter than prior art magnetic rollers, while still delivering a significantly increased attractive force than was possible with the prior art magnetic rollers. However, magnets for top rolls having apron belts 30 provided thereon can be of greater diameter than those rolls not having apron belts 30, while still providing favorable drafting. Also, magnets of larger diameters may find particular use in drafting systems such as those found on roving machines, draw frames, carding machines and the like.

In the embodiment illustrated, the north poles of each magnet 38, 40 are adjacent to the central pole piece 36, and the south poles of each of the magnets 38, 40 are adjacent to the end pole pieces 44, 46, respectively, although other orientations of the magnets 38, 40 with respect to the other pole pieces could also be used.

The shaft 34 passing through the magnetic roll 10 is preferably a constant diameter throughout its length. This is contrasted with prior magnetic roller designs, which were prone to de-magnetization, and which therefore had to be oriented in a specific relationship to prevent de-magnetization caused by adjacent magnetic rollers. To prevent improper orientation, some magnetic roller designs have used gudgeons of different diameters which would prevent the magnetic roller from being inserted in an improper orientation. Because the rare earth magnets used in the magnetic rolls of the present invention are not subject to de-magnetization, orientation of the rolls with respect to adjacent rolls is not critical, and therefore, the shaft 34 does not require ends of differing diameters. However, while shaft 34 has been shown for coaxially aligning pole to members 36, 44, 46, and magnets 38, 40 together, the apertures of the pole members 36, 44, 46, and magnets 38, 40 could be eliminated and half-shafts or gudgeons attached to spacers 50 used to support roller 10 instead.

It is also to be understood that a variety of shapes of pole members 36, 44, 46 and magnets 38, 40 could be used instead of the cylindrical shapes illustrated. Although roll 10 is shown having only two magnets and three pole members, a larger or smaller number of magnets and pole members could also be used to construct roller 10. Further, the diameters, widths, and masses of the magnets and pole members could be varied with respect to that disclosed to also achieve satisfactory results.

For example, the central pole member and end pole members of each roll can be of greater or less width than the width of the magnets, depending on the space available on the roll and for the roll itself in the specific drafting application. Specifically, there may be embodiments where it is desirable to have pole members of lesser width and/or mass than the magnets. Also, because the spindle gauge of spinning machines can vary from one type of machine to another, the width relationship between the pole members and the magnets can vary depending on the particular gauge of spinning machine on which the rolls are used. It has been found that the pressure exerted between the rollers of the roller pairs, wherein at least one of the rollers is a magnetic roller constructed in accordance with the present invention, may be increased when the mass of the central pole member is greater than the mass of either of the magnets. Similarly, the pressure exerted can be increased by increasing the mass of the end pole members such that the mass of each of the end pole members is greater than the mass of the magnets. The increase in attractive force caused by increasing the mass of the pole members in relation to the magnets will be limited to a point, in that sufficient magnet mass must be present on the roller to provide at least a minimum threshold of attractive force and that the roller is of finite length, thereby placing inherent size limitations on the relationships between the pole members and the magnets.

Another variation of the present magnetic roller design could include eliminating the central pole member altogether, using only the end pole members. Alternately, all pole members could be eliminated, with a single or series of magnets extending the length of the roll 10, or a portion thereof. Such a design could include resilient cots thereon for engaging the lower driven roller of a roller pair and the yarn in a nip zone formed therebetween.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by one of ordinary skill in the art, without departing from the spirit or scope of the following claims.

What is claimed is:

1. A magnetic roll for use in conjunction with a driven roll of a drafting roller pair in a textile drafting system, comprising:

at least one circumferentially extending rare earth magnet having a first end and a second end opposite said first end;

at least one resilient member associated with said at least one rare earth magnet for engaging the driven roll of the textile drafting system; and support means associated with said at least one rare earth magnet and said at least one resilient member for substantially coaxially supporting said at least one magnet and said at least one resilient member together for rotation in the textile drafting system.

2. The magnetic roll as defined in claim 1, further wherein said at least one rare earth magnet includes first and second rare earth magnets.

3. The magnetic roll as defined in claim 2, further comprising at least one central pole member having a first side and second side opposite said first side, said central pole member being positioned between said first and second rare earth magnets.

4. The magnetic roll as defined in claim 1, further comprising a first end pole member positioned proximate to said first end of said at least one rare earth magnet, and a second end pole member positioned proximate to said second end of said at least one rare earth magnet.

5. A magnetic roll as defined in claim 3, wherein said central pole member is constructed of a magnetic-attractive material.

6. A magnetic roll as defined in claim 1, wherein said at least one resilient member includes first and second cot members, one of each being provided on each end of the magnetic roll.

7. A magnetic roll as defined in claim 1, wherein said at least one rare earth magnet is constructed of a composition including neodymium, iron, and boron.

8. A magnetic roll as defined in claim 4, wherein the combined mass of said first and second end pole members is greater than the mass of said at least one rare earth magnet.

9. A magnetic roll for use in a textile drafting system, comprising:

at least one pole member having a first side and a second side opposite said first side;

first and second rare earth magnets; said first magnet being positioned adjacent said first side of said central pole member, and said second magnet being positioned adjacent said second side of said central pole member;

a first end pole member positioned adjacent to said first rare earth magnet, opposite said first side of said central pole member, and a second end pole mender positioned adjacent to said second rare earth magnet, opposite said second side of said central pole member;

at least one shaft member associated with said first and second end pole members for maintaining said central pole member, said first and second rare earth magnets, and said first and second end pole members in substantially coaxial alignment with respect to one another.

10. A magnetic roll as defined in claim 9, wherein:

said central pole member defines a central pole member aperture therein;

each of said first and second rare earth magnets define a magnet aperture therein;

each of said first and second end pole members define an end pole aperture therein; and said support means includes an elongated shaft, said elongated shaft passing through said central pole member aperture and each of said magnet apertures of said first and second rare earth magnets and each of said end pole apertures of said first and second end pole members, for maintaining said central pole member, said first and second rare earth magnets, and said first and second end pole members in substantially coaxial alignment with respect to one another.

11. A magnetic roll as defined in claim 9, wherein said at least one shaft member is an elongated shaft constructed of non-magnetic material.

12. A magnetic roll as defined in claim 9, wherein said central pole member and said first and second end pole members are constructed of a ferrous material.

13. A magnetic roll as defined in claim 9, further comprising first and second spacer members, said first spacer member being positioned adjacent to said first end pole member, and said second spacer member being positioned adjacent to said second end pole member.

14. A magnetic roll as defined in claim 13, wherein said first and second spacer members are constructed of a non-ferrous material.

15. A magnetic roll as defined in claim 13, further comprising said first and second spacer members each having a resilient cot provided thereon.

16. A magnetic roll as defined in claim 9, wherein said central pole member is of greater width than each of said first and second magnets.

17. A magnetic roll as defined in claim 9, wherein said first and second rare earth magnets are constructed of a composition including neodymium, iron, and boron.

18. A magnetic roll as defined in claim 9, wherein said central pole member and said first and second rare earth magnets are substantially cylindrical and said central pole member is of a larger diameter than each of said first and said second magnets.

19. A magnetic roll as defined in claim 9, wherein said first and second rare earth magnets and said first and second end pole members are substantially cylindrical and wherein the diameter of each of said first and said second end pole members is larger than the diameter of each of said first and second magnets.

20. A magnetic roll as defined in claim 9, wherein each of said first and second end pole members is of greater width than each of said first and second rare earth magnets.

21. A magnetic roll as defined in claim 9, wherein each of said first and second end pole members is of less width than each of said first and second rare earth magnets.

22. A magnetic roll as defined in claim 9, wherein the combined mass of said first and second end pole members is greater than the combined mass of said first and second rare earth magnets.

23. A magnetic roll as defined in claim 9, wherein the mass of said central end pole member is greater than the mass of either of said first and second rare earth magnets.

24. A magnetic roll for use in a textile drafting system, comprising:

at least one central pole member having a first side and a second side opposite said first side;

first and second rare earth magnets; said first rare earth magnet being positioned adjacent said first side of said central pole member, and said second rare earth magnet being positioned adjacent said second side of said central pole member;

a first end pole member positioned adjacent to said first rare earth magnet, opposite said first side of said central pole member, and a second end pole member positioned adjacent to said second rare earth magnet, opposite said second side of said central pole member; and at least one shaft member associated with said central pole member aperture, said first and second magnets, and said first and second end pole members for maintaining said central pole member, said first and second magnets, and said first and second end pole members in substantially coaxial alignment with respect to one another.

25. A magnetic roll as defined in claim 24, further comprising first and second spacers, said first spacer being positioned adjacent to said first end pole member, and said second spacer being positioned adjacent to said second end pole member; each of said first and second spacers defining an aperture therethrough for receipt of said elongated shaft.

26. A magnetic roll as defined in claim 25, further comprising first and second aprons associated with each of said first and second spacers, respectively; and first and second belts; said first belt passing over said first spacer and said first apron for movement with respect thereto, and said second belt passing over said second spacer and said second apron for movement with respect thereto.

27. A magnetic roll as defined in claim 24, wherein said first and second rare earth magnets are constructed of a composition including neodymium, iron, and boron.

28. A magnetic roll assembly for use in conjunction with a roll of a drafting roller pair in a textile drafting system, the magnetic roll assembly comprising:

first and second rare earth magnets, each of said first and second rare earth magnets having an end; and at least one pole member positioned between the end of said first rare earth magnet and the end of said second rare earth magnet.

29. A magnetic roll assembly as defined in claim 28, further comprising at least one resilient member provided on the roll.

30. A magnetic roll assembly as defined in claim 28, further comprising support means associated with said first and second rare earth magnets and said pole member for substantially coaxially supporting said first and second rare earth magnets and said pole member together for rotation in the textile drafting system.

* * * * *